US006758790B1

(12) United States Patent
Ellis

(10) Patent No.: US 6,758,790 B1
(45) Date of Patent: Jul. 6, 2004

(54) LOW IMPACT WALKING/JOGGING EXERCISE MACHINE

(75) Inventor: Patrick D. Ellis, Milwaukee, WI (US)

(73) Assignee: Northland Industries, Inc., South Milwaukee, WI (US)

( * ) Notice: Subject to any disclaimer, the term of this patent is extended or adjusted under 35 U.S.C. 154(b) by 0 days.

(21) Appl. No.: 10/235,038

(22) Filed: Sep. 4, 2002

(51) Int. Cl.[7] ..... A23B 22/04
(52) U.S. Cl. ..... 482/52; 482/57; 482/62
(58) Field of Search ..... 482/51, 52, 53, 482/57, 58, 59, 62, 70, 79, 80

(56) References Cited

U.S. PATENT DOCUMENTS

| | | | | |
|---|---|---|---|---|
| 3,316,898 | A | 5/1967 | Brown | |
| 5,562,574 | A | 10/1996 | Miller | |
| 5,823,917 | A | 10/1998 | Chen | |
| 5,836,854 | A | 11/1998 | Kuo | |
| 5,846,166 | A | 12/1998 | Kuo | |
| 5,882,281 | A | 3/1999 | Stearns et al. | |
| 5,899,833 | A | 5/1999 | Ryan et al. | |
| 5,947,872 | A | 9/1999 | Ryan et al. | |
| 5,997,445 | A * | 12/1999 | Maresh et al. | 482/70 |
| 6,019,710 | A | 2/2000 | Dalebout et al. | |
| 6,042,512 | A * | 3/2000 | Eschenbach | 482/52 |
| 6,090,013 | A | 7/2000 | Eschenbach | |
| 6,099,439 | A | 8/2000 | Ryan et al. | |
| 6,126,574 | A | 10/2000 | Stearns et al. | |
| 6,135,926 | A | 10/2000 | Lee | |
| 6,176,814 | B1 | 1/2001 | Ryan et al. | |
| 6,217,485 | B1 | 4/2001 | Maresh | |
| 6,254,514 | B1 | 7/2001 | Maresh et al. | |
| 6,390,954 | B1 * | 5/2002 | Lee | 482/52 |
| 6,398,695 | B2 | 6/2002 | Miller | |
| 6,454,682 | B1 * | 9/2002 | Kuo | 482/52 |

* cited by examiner

*Primary Examiner*—Nicholas D. Lucchesi
*Assistant Examiner*—Tam Nguyen
(74) *Attorney, Agent, or Firm*—Andrus, Sceales, Starke & Sawall, LLP

(57) ABSTRACT

A walking/jogging exercise machine includes a frame supported upon a generally horizontally extending floor, and a main driveshaft mounted for rotation on the frame. A pair of cams is mounted for rotation on the driveshaft, and a pair of first track assemblies is fixed to the frame. A pair of second track assemblies is rotatably attached to the frame and includes brackets having first rollers which ride upon the peripheries of the cams. A pair of non-aligned, foot assemblies are mounted for sliding movement on the first and second track assemblies. A linkage arrangement is provided between the drive shaft and the foot assemblies for transferring the movement of the foot assemblies to the cams so as to produce a change in the angle of a user's ankle which will result in a natural walking/jogging motion.

16 Claims, 8 Drawing Sheets

LOW IMPACT WALKING/JOGGING EXERCISE MACHINE

FIELD OF THE INVENTION

The present invention relates generally to walking and jogging conditioning devices and, more particularly, pertains to stand up exercise equipment wherein a user's feet travels through a curved path of travel to produce a more natural motion of walking or jogging.

BACKGROUND OF THE INVENTION

Recognizing the benefits of exercise contrasted with the various constraints of time and space limiting exercisers in using their lower and upper body muscles, various walking/jogging machines have been designed to provide for physical development and aerobic exercise. It is generally desirable to create a machine that will allow a user to walk or jog without the impact on the user's joints that occur while running on the ground or on a treadmill. There are a number of elliptical machines on the market today which achieve this result, but force the users into an unnatural motion.

SUMMARY OF THE INVENTION

It is a general object of the present invention to provide an exercising machine which enables an individual to exercise lower and upper body muscles over a range of motion.

It is also an object of the present invention to provide an exercise machine which permits one's feet to move along a smooth path during exercise.

It is a further object of the present invention to provide an exercise machine which utilizes a drive and cam arrangement and a linkage system to produce a low impact, natural ambulatory motion.

In one aspect of the invention, a walking/jogging exercise machine includes a frame supported upon a generally horizontally extending floor. A drive shaft is mounted for rotation, and a pair of cams is mounted for rotation on the drive shaft. A pair of first track assemblies is fixed to the frame, and a pair of second track assemblies is rotatably attached to the frame and includes brackets having first rollers which ride upon the peripheries of the cams. A pair of non-aligned foot assemblies is mounted for sliding movement on the first and second track assemblies. A linkage arrangement is provided between the drive shaft and the foot assemblies for transferring the movement of the foot assemblies to the cams so as to produce a change in the angle of a user's ankle which will result in a natural walking/jogging motion.

The frame includes a base member, vertical uprights connected to the base member and a rearwardly angled support member joined to the base member. A circular drive pulley is mounted for rotation on the drive shaft between the cams. A brake assembly is mounted forwardly of the vertical uprights and is entrained with the drive pulley by a drive belt. The frame carries an electronic controller connected to the brake assembly for providing resistance to the drive shaft. The first track assemblies take the form of downwardly and forwardly declined, rear guide shaft assemblies disposed at an angle of about 10 degrees to the floor. The second track assemblies take the form of front guide shaft assemblies, each including a cylindrical tube connected to a bifurcated bracket for holding one of the first rollers which ride upon the cam assembly. The cylindrical tube pivots through an angular range of about 5 to 10 degrees relative to the floor. Each foot assembly includes a foot pedal mounted upon a support bar having a rearward end provided with a second roller attached to a carriage assembly which rides back and forth on one of the rear guide shaft assemblies. Each foot assembly includes a forward, lower end equipped with a third roller which rolls back and forth along the cylindrical tube of the front guide shaft assembly. The carriage assembly includes a pair of side plates for holding a pair of upper rollers which ride upon an upper surface of the rear guide shaft assembly, and a lower roller which rides upon a lower surface of the rear guide shaft assembly. An adjustment device for changing the position of the upper and lower rollers is provided on the carriage assembly. A pair of swing arms is pivotally connected to an upper portion of the support member and carries a pair of handles fixed thereto. The support member carries a pair of handgrips fixed thereto. The linkage arrangement includes a pair of bell cranks attached at one end of the drive shaft, and a pair of forward connecting links, each having a first end pivotally connected to another end of one of the bell cranks, and a second end pivotally connected to a mid portion of one of the swing arms. A pair of rear connecting links is also provided, each having a first end pivotally secured to a bottom end of one of the swing arms, and a second end pivotally connected to one of the carriage assemblies.

The invention further contemplates a method of walking/jogging in an exercise machine, the method including the steps of providing a frame supported on a generally horizontally extending floor; mounting a drive shaft for rotation on the frame; mounting a pair of cams for rotation on the drive shaft; fixing a pair of first track assemblies to the frame; rotatably mounting a pair of second track assemblies to the frame such that the second track assemblies have brackets for holding first rollers which ride upon the peripheries of the cams; mounting a pair of non-aligned, foot assemblies for sliding movement on the first and second track assembly; and providing a linkage arrangement between the cams and the foot assemblies for transferring movement of the foot assemblies to the cams so as to produce a change in the angle of a user's ankle which will result in a natural walking/jogging motion.

Various other objects, features and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE INVENTION

The present invention is advantageously directed to an exercise machine which moves a user's feet and legs through a natural range of motion associated with walking, jogging and running.

General Overview

Figure 1:
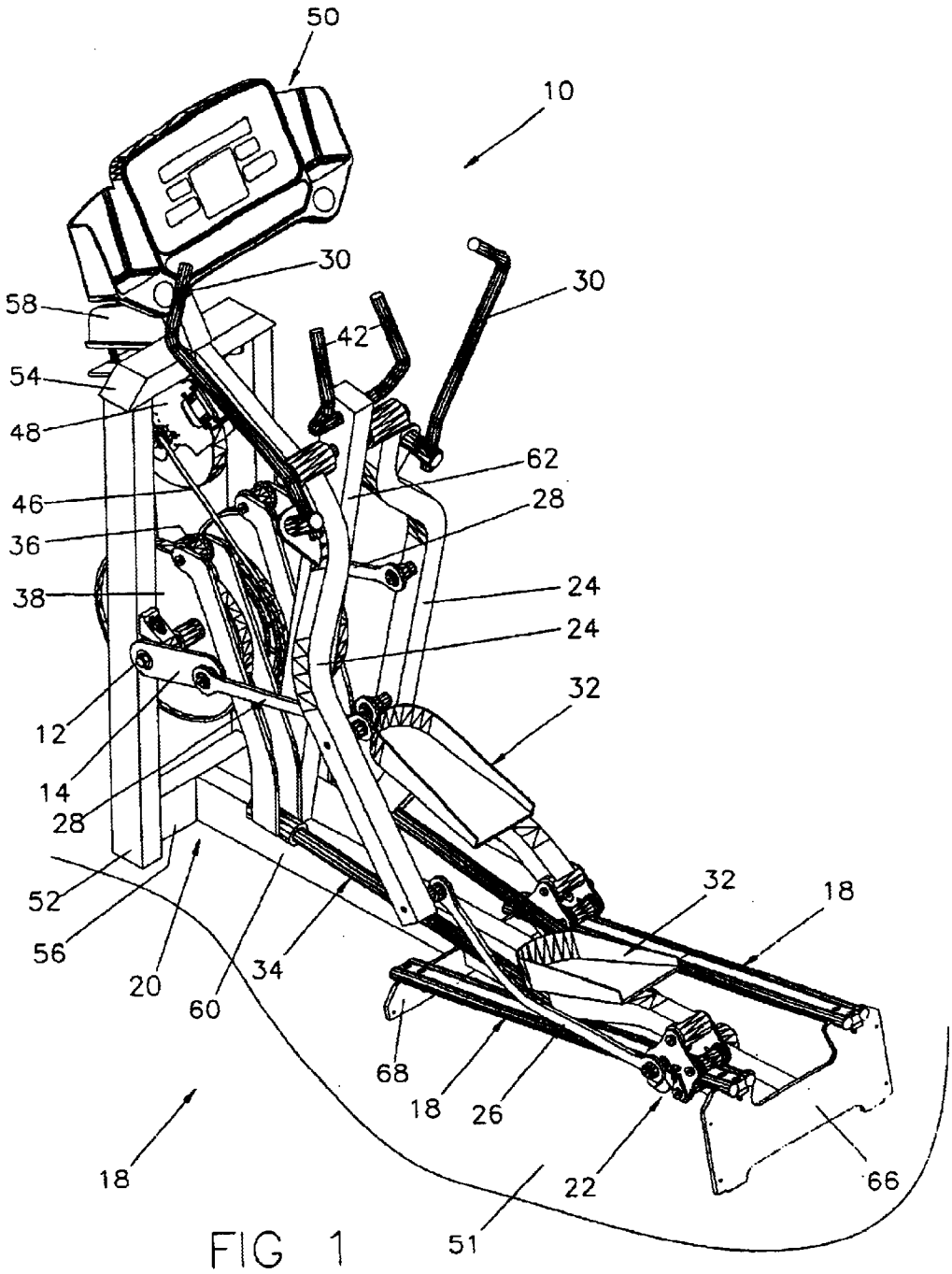
FIG. 1 is a front perspective view of a low impact walking and jogging exercise machine constructed in accordance with the invention, certain parts being removed for clarity.
Figure 2:
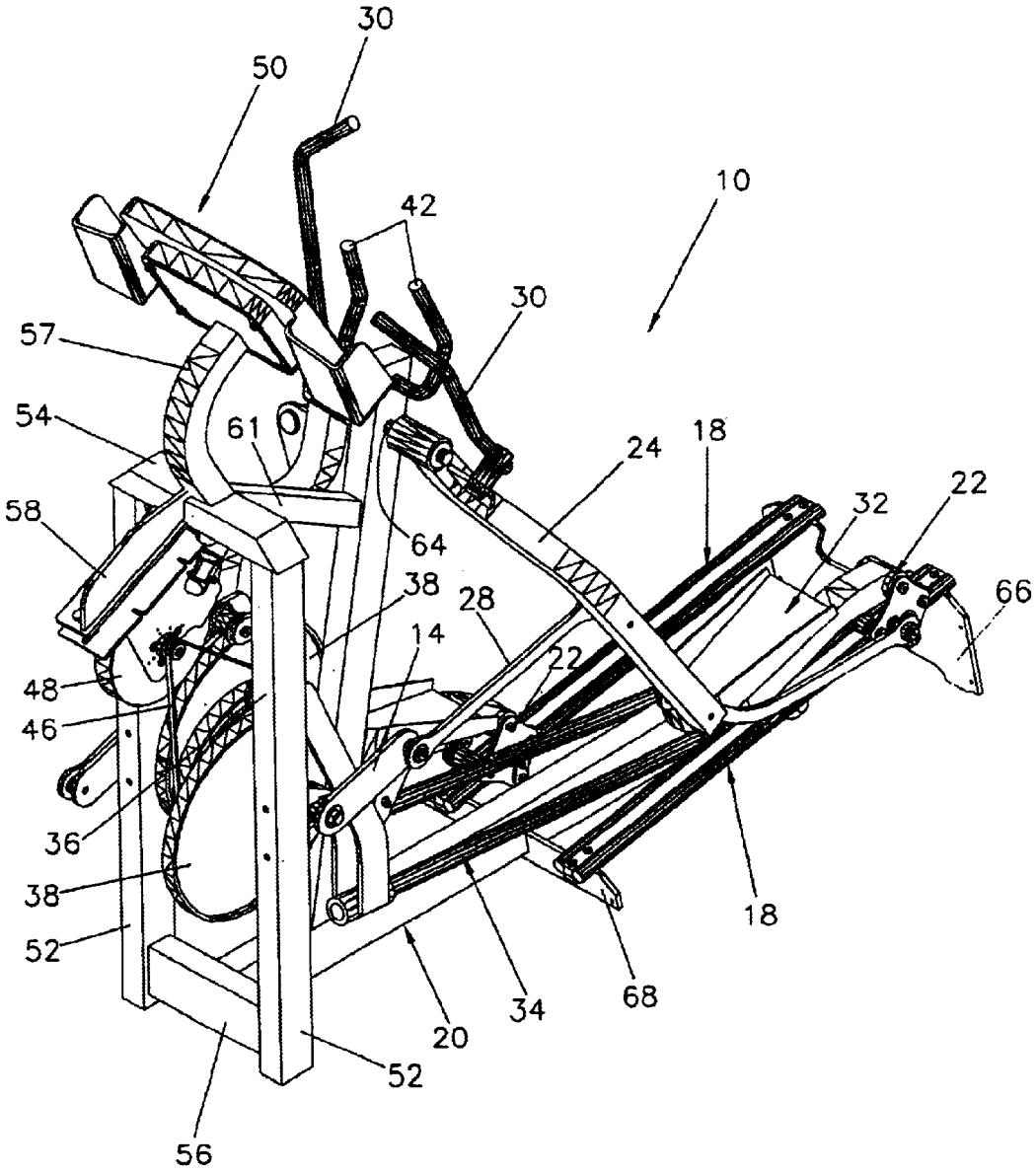
FIG. 2 is a rear perspective view of the exercise machine shown in FIG. 1.
Figure 3:
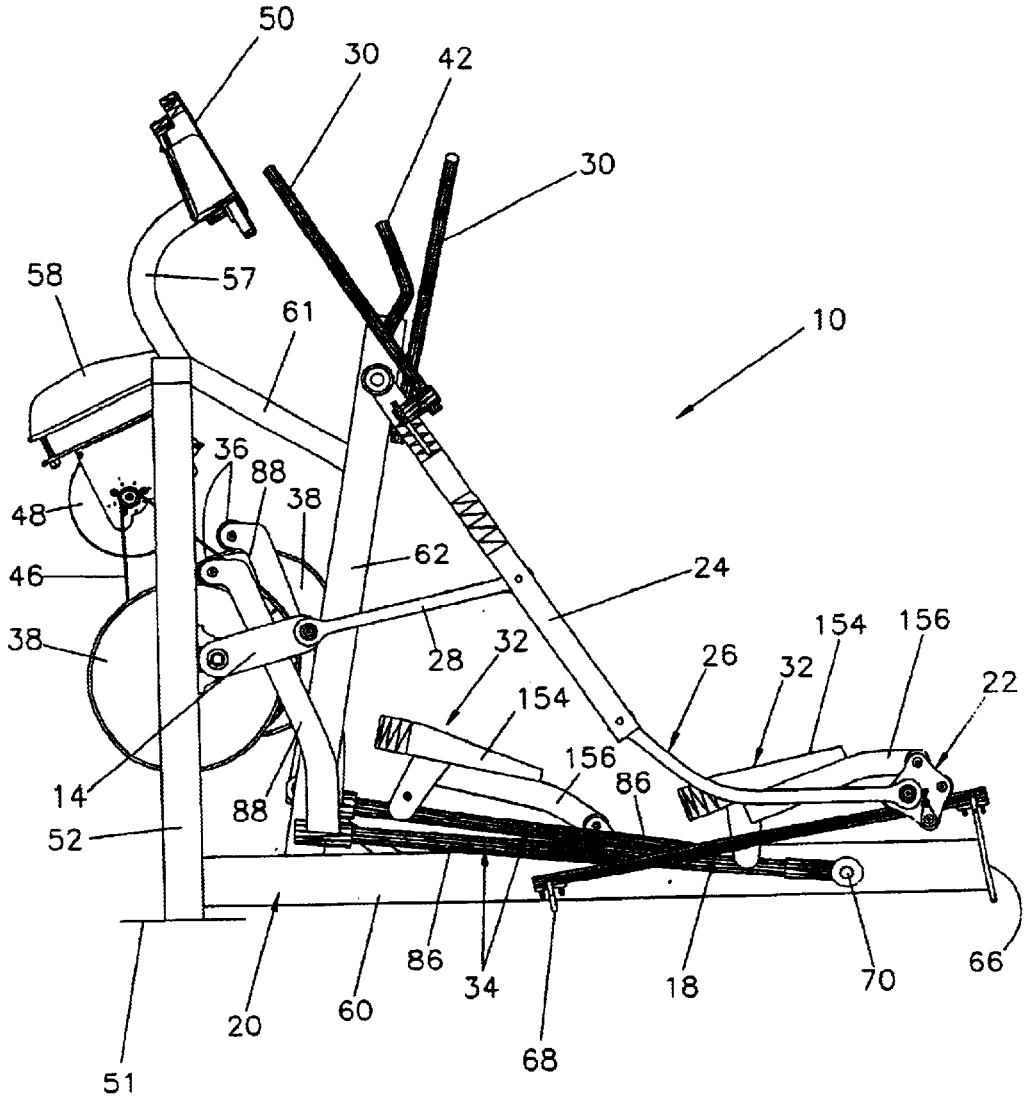
FIG. 3 is an elevational view of the exercise machine shown in FIG. 1.

Referring now to the drawings, FIGS. 1, 2 and 3 illustrate an exercise machine 10 constructed in accordance with the present invention.

The exercise machine 10 is designed with a left side and a right side which are identical. The left side and right side are staggered in such a manner that when the left foot is at the extreme rear extent of its travel, the right foot is at the extreme forward extent of its travel. This interconnection is accomplished with the use of a main drive shaft 12 and a pair of bell cranks 14, 16 which are attached to the main drive shaft 12 180 degrees in rotation to each other. Because the left and right sides of the machine 10 are symmetrical about a plane containing the longitudinal axis of the exercise machine 10, the following discussion will be only of the left side.

The machine 10 has a rear guide shaft assembly 18 which is fixedly mounted on both ends to a machine frame 20. A carriage assembly 22 is attached to the rear guide shaft assembly 18 with a wheel arrangement which allows the carriage assembly 22 to move forward and back on the rear guide shaft assembly 18. A curved swing arm 24 is pivotally connected to the machine frame 20. A curved connecting link 26 is pivotally connected on one end to the swing arm 24, and pivotally connected on the other end to the carriage assembly 22. A forward connecting link 28 is pivotally connected on one end to the swing arm 24 and pivotally connected on the other end to the bell crank 14. An upper body handle 30 is attached to the upper end of the swing arm 24. A foot assembly 32 is pivotally connected to the carriage assembly 22. The machine 10 also has a front guide shaft assembly 34 which is pivotally connected on the rear end to the machine frame 20. The front guide shaft assembly 34 has a cam roller 36 (FIG. 6) mounted on the other end. A cam 38 is affixed to the main drive shaft 12. A roller 40 (FIG. 9) is mounted at the front end of the foot assembly 32 to ride on the front guide shaft assembly 34. The drawings show the upper body handle 30 attached to a top end of the swing arm 24. Although this enhances the function of the machine 10, it is not necessary to the operation. Instead, the machine 10 also carries a handgrip 42 fixed to the machine frame 20. In the drawings, a circular drive pulley 44 is shown which is attached to the main drive shaft 12. This drive pulley 44 is connected with a drive belt 46 to a generator/eddy current brake assembly 48 which is connected to an electronic controller 50. This system provides resistance of the rotation of the main drive shaft 12 to increase the difficulty of the exercise. It should be noted that other methods of resistance could be used, such as a simple friction brake.

Component Details

The exercise machine frame 20 rests upon a floor 51 and includes a pair of vertical uprights 52 connected to a top transverse member 54 and a bottom transverse member 56. A curved neck 57 is connected to the top transverse member 54 and supports the controller 50. An attachment bracket 58 extends rearwardly from the top transverse member 54 for mounting the brake assembly 48 thereto. The frame 20 also includes an elongated base member 60 having a support link 61, a rearwardly angled, support member 62 which carries a first pivot shaft 64 and the fixed handgrips 42 at the upper end thereof. The base member 60 is provided with a rear transverse retaining member 66 and a forward transverse retaining member 68. A second pivot shaft 70 is provided on the base member 60 near the rear transverse retaining member 66. Both retaining members 66, 68 are forwardly angled and equipped with rectangular plates 72 (FIG. 5) for affixing the rear guide shaft assemblies 18 thereto.

Figure 5:
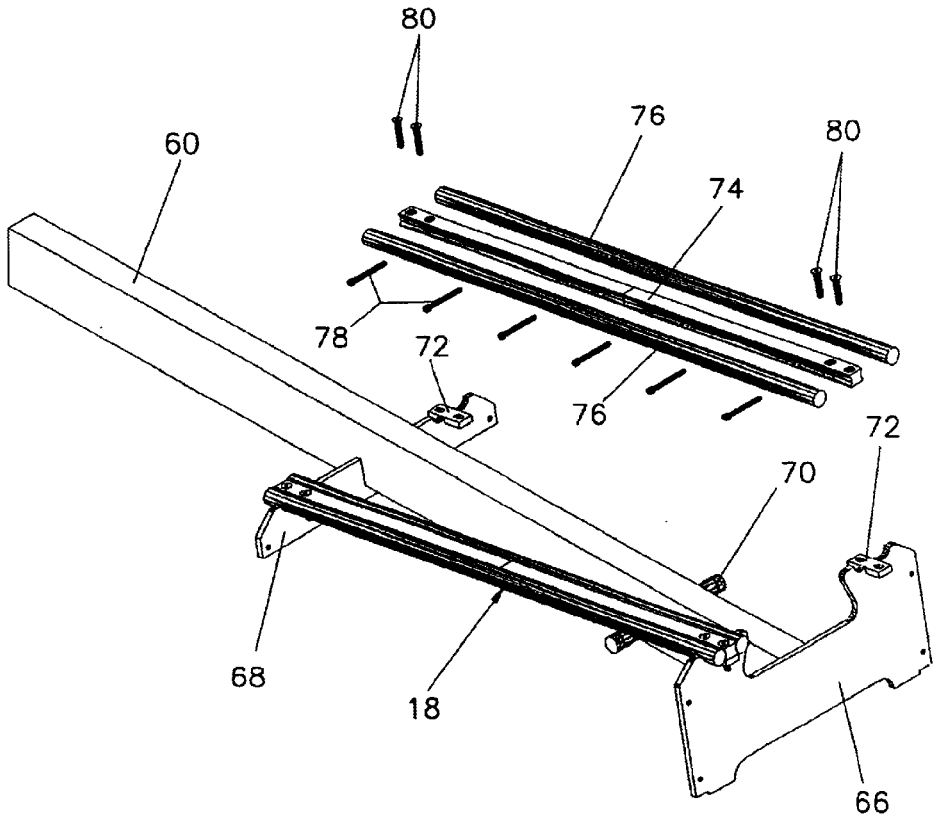
FIG. 5 is an exploded view of the rear guide shaft assembly of the exercise machine.

As seen in FIG. 5, each of the rear guide shaft assemblies 18 includes a guide shaft spacer 74 flanked by a pair of guide shaft tubes 76. The spacer 74 and tubes 76 are held together by a plurality of transversely extending bolts 78. At each end of the spacers 74, vertically extending bolts 80 pass through holes formed therein, and are screw threaded into openings in the rectangular plates 72 of the retaining members 66, 68. The rear guide shaft assemblies 18 are positioned at an angle of about 10 degrees relative to the floor 51 (FIG. 3).

Figure 6:
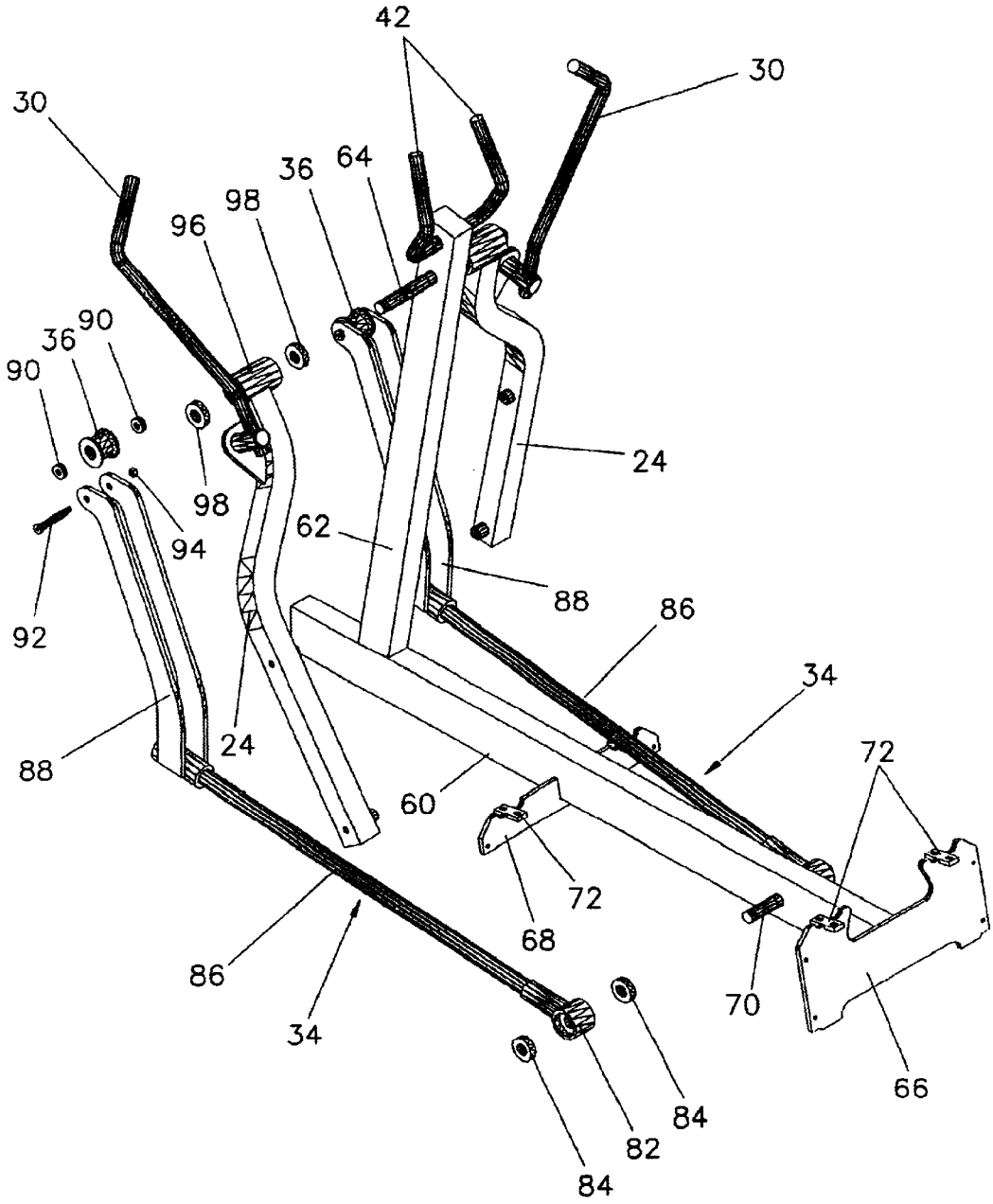
FIG. 6 is an exploded view of the front guide shaft assembly and swing arm of the exercise machine.

Turning to FIG. 6, the rearward end of each front guide shaft assembly 34 includes a cylindrical cuff 82 for receiving a pair of pop-in bearings 84. The cuff 82 and bearings 84 fit over the second pivot shaft 70 on the base member 60 and enable a pivotal mounting for the rearward end of the front guide shaft assemblies 34. Each of the front guide shaft assemblies 34 is comprised of an elongated cylindrical tube 86, and a forwardly projecting, bifurcated bracket 88 having a pair of aligned apertures at its upper end. The tube 86 is pivoted at an angle of about 5 degrees to 10 degrees during operation of the exercise machine 10. The cam roller 36 has openings which are positioned in alignment with the bracket apertures so that the cam roller 36 may be interposed between the brackets 88. Bearings 90 are provided in the cam roller 36, and a bolt 92 passes through the apertures of the brackets 88 and the openings of the cam roller 36 and is secured by a nut 94. Each cam roller 36 rides upon the periphery of its cam 38. The upper end of each swing arm 24 has a mounting cylinder 96 provided with pop-in bearings 98. The mounting cylinder 96 and bearings 98 slide over the first pivot shaft 64 at the top of the support member 62 to provide a pivotal mounting.

Figure 7:
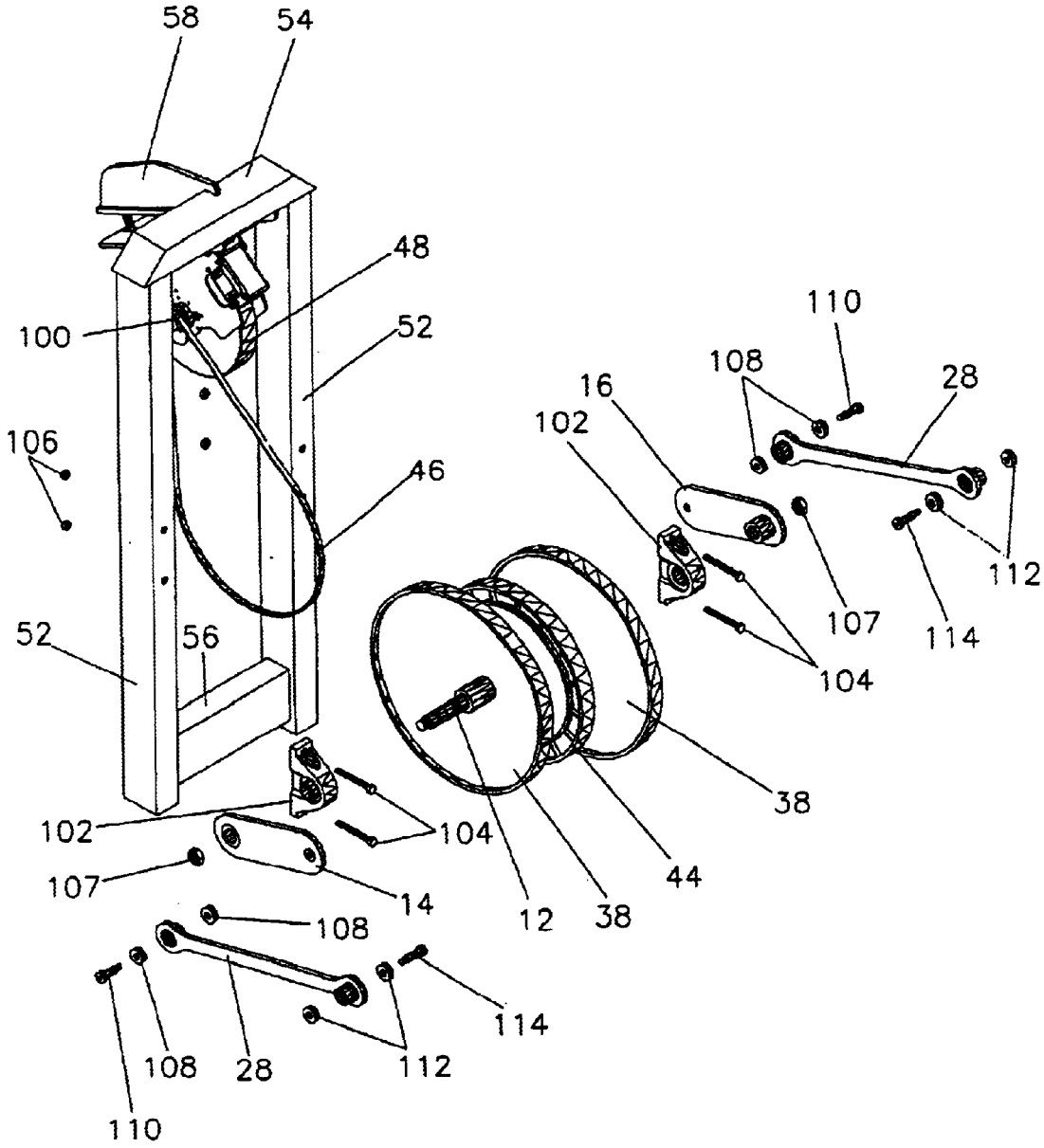
FIG. 7 is an exploded view of the drive and cam arrangement of the exercise machine.

Referring to FIG. 7, the drive pulley 44 for the brake assembly 48 is placed between the cams 38. The main drive shaft 12 passes through offcenter locations of the cams 38 and the center of the drive pulley 44. The drive belt 46 wraps around the drive pulley 44 and a shaft 100 on the brake assembly 48. Pillow block bearings 102 are secured by bolts 104 and nuts 106 to the vertical uprights 52 of the frame 20. Each end of the main drive shaft 12 passes through a respective pillow block bearing 102 and a large hole on one end of the bell crank 14 or 16 and is fitted with a retaining nut 107. The other end of the bell crank 14 or 16 has a small hole which is aligned with a forward end opening of the forward connecting link 28. Pop-in bearings 108 are provided on each side of the forwardly connecting link 28. A link bolt 110 passes through the bearings 108 and the forward end opening of the forward connecting link 28. A rearward end of the forward connecting link 28 includes pop-in bearings 112 and a link bolt 114 so that it can be pivotally connected to an inside, mid-portion of the swing arm 24.

Figure 8:
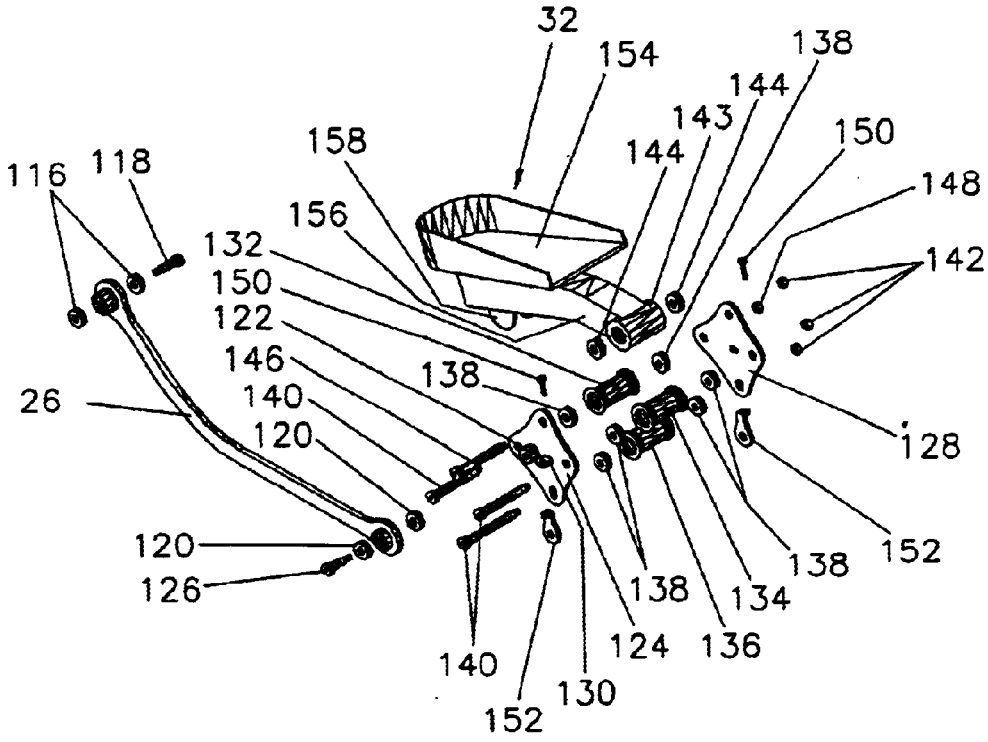
FIG. 8 is an exploded view of the carriage assembly of the exercise machine.

FIG. 8 illustrates the forward end of the rear connecting link 26 with pop-in bearings 116 and a link bolt 118 so that the forward end is pivotally secured to the inside, bottom end of the swing arm 24 (FIG. 3). The rearward end of the rear connecting link 26 has pop-in bearings 120 and is aligned with a laterally extending boss 122 on an outer side plate 124 of the carriage assembly 122. A link bolt 126 pivotally connects the rearward end of the rearward connecting link 26 to the side plate 124. The carriage assembly 22 also includes an inner side plate 128. The side plates 124, 128 are formed with four holes in registration with each other, and an outwardly protruding tab 130. Three tubular rollers 132, 134, 136, each having pop-in bearings 138, are aligned with appropriate holes in the side plates 124, 128 and are mounted between the side plates 124, 128 by means of pivot bolts 140 and roller nuts 142. In addition, a rearward cylindrical end 143 of the foot assembly 32 having pop-in bearing 144 is aligned with one set of the holes in the side plates 124, 128, and is pivotally attached between the side plates 124, 128 by pivot bolt 146 and roller nut 148. An adjustment bolt 150 passes through an opening in the tab 130 of each side plate 124, 128 and selectively engages an adjustment member 152 connected to the side plate 124, 128. The adjustment member 152 is used to set the position of the rollers 132, 134, 136 on the carriage assembly 22.

Figure 9:
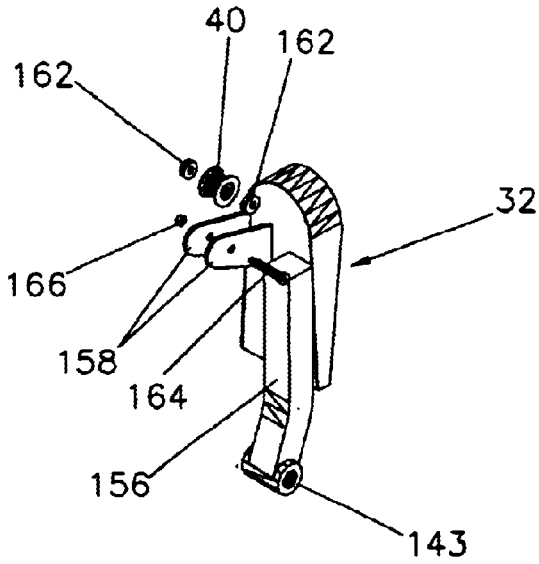
FIG. 9 is an exploded view of the foot assembly of the exercise machine.

The foot assembly 32 shown in FIG. 9 includes a walled foot pedal 154 for positioning the user's foot thereon. The foot pedal 154 is mounted on a support bar 156 having the rearward cylindrical end 143. A front, lower end of the foot pedal 154 has a bifurcated bracket 158 for holding roller 40 having pop-in bearings 162 therebetween. A pivot bolt 164 passes through aligned holes in the bracket 158, bearings 162 and roller 40 and receives a roller nut 166 to rotatably hold the roller 40 in place. The roller 40 at the front of the foot assembly 132 rolls along the tubes 86 of the front guide shaft assembly 34. The carriage assemblies 22 connected to the rear of the foot assemblies 32 have upper rollers 132, 134 which ride along the top of the rear guide shaft assemblies 18, and a lower roller 136 which rolls along the bottom of the rear guide shaft assemblies 18.

Operation

Figure 4A:
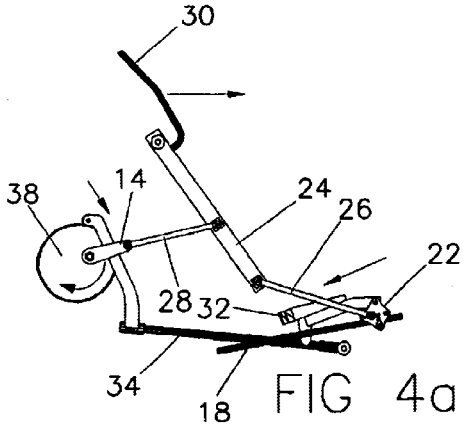
FIGS. 4*a*–4*f* are views showing the sequence of operation of the exercise machine.

FIGS. 4*a* through 4*f* show the sequence of movement in the operation of the exercise machine 10. In FIG. 4*a*, the foot assembly 32 in a toe down condition is in the most rearward position of travel, simulating the end of a step. As the foot assembly 32 is moved forward on carriage rollers 40, 132, 134, 136 moving along the tubes 80 and the rear guide shaft assembly 18, the rear connecting link 26 forces the swing arm 24 forward as the mid portion of swing arm 24 pivots on the rear end of the forward connecting link 28. This moves the upper body handle 30 rearward. The movement of the forward connecting link 28 causes the bell crank 14 or 16 to rotate the main drive shaft 12 and cam 38.

Figure 4D:
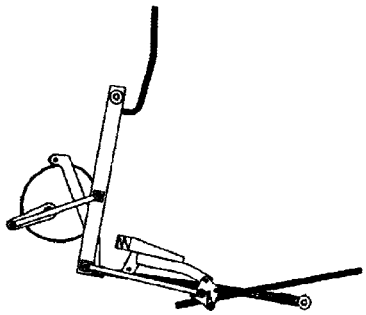
Figure 4B:
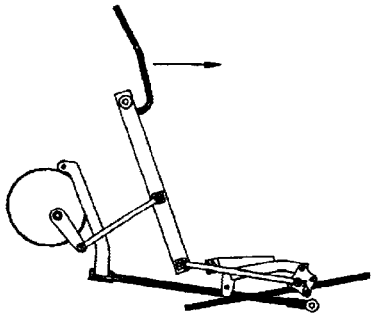
Figure 4E:
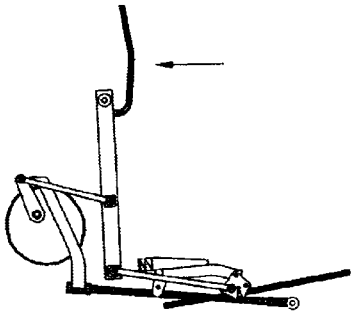
Figure 4C:
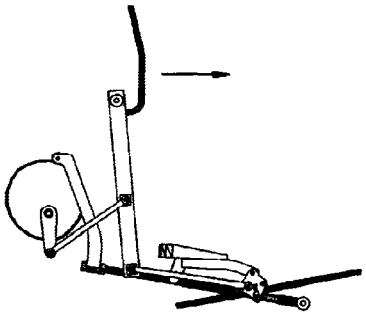

FIGS. 4*b* and 4*c* show the foot assembly 32 moving forward. As the cam 38 rotates, it lifts the cam roller 36 which raises the front guide shaft assembly 34, raising the front of the foot assembly 32 and simulating raising the user's foot and changing the angle of the ankle through the motion, as happens when stepping forward.

FIG. 4*d* shows the foot assembly 32 in a toe up condition at its forwardmost position of travel. The cam 38 is rotating to its lowest height of lift, simulating the user making ground contact to propel himself forward. It can also be noted that because the cam 38 is dropping, the user's weight helps rotate the cam 38 through the direction change of the foot assembly 32, preventing the bell crank 14 or 16 from locking up in a change over position.

Figure 4F:
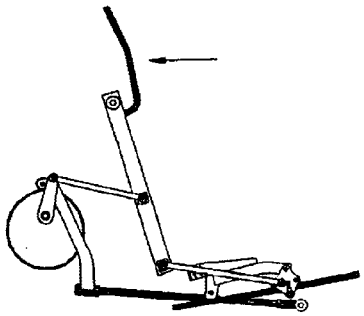

FIGS. 4*e* and 4*f* show the foot assembly 32 returning to the rearward position. Through this motion, the cam 38 has no lift, simulating the user propelling himself forward. Because the rear and front guide shaft assemblies 18, 34, respectively, are at opposite angles relative to level, the angle of the foot assembly 32 changes through the motion, as a user's ankle change would change in walking.

During the motion of the exercise machine 10, the drive pulley 44 will rotate with the main drive shaft 12. Because the drive pulley 44 is connected by the drive belt 46 to the brake assembly 48 and the electronic controller 50, a varying level of resistance is provided to the main drive shaft 12 to establish the difficulty of the exercise. The electronic controller 50 is preferably battery powered and is designed to provide a set of various walking, or jogging programs. The controller 50 also is programmed to reflect distance traveled, time elapsed, calories burned and other desirable perimeters.

Various alternatives and embodiments are contemplated as being within the scope of the following claims particularly pointing out and distinctly claiming the subject matter regarded as the invention.

I claim:

1. A walking/jogging exercise machine comprising:

a frame supported upon a generally horizontally extending floor;

a drive shaft mounted for rotation on the frame;

a pair of cams mounted for rotation on the drive shaft;

a pair of first track assemblies fixed to the frame;

a pair of second track assemblies pivotally attached to the frame and including brackets having first rollers which ride upon peripheries of the cams;

a pair of non-aligned, foot assemblies mounted for sliding movement on the first and second track assembly; and a linkage arrangement between the drive shaft and foot assemblies for transferring movement of the foot assemblies to the cams so as to produce a change in the angle of a user's ankle which will result in a natural walking/jogging motion.

2. The exercise machine of claim 1, wherein the frame includes a base member, a pair of vertical uprights connected to the base member, and a rearwardly angled support member joined to the base member.

3. The exercise machine of claim 2, wherein a circular drive pulley is mounted for rotation on the drive shaft between the cams.

4. The exercise machine of claim 3, wherein a brake assembly is mounted forwardly of the vertical uprights and is entrained with the drive pulley by a drive belt.

5. The exercise machine of claim 4, wherein the frame carries an electronic controller connected to the brake assembly for providing resistance to the drive shaft.

6. The exercise machine of claim 1, wherein the first track assemblies take the form of downwardly and forwardly declined, rear guide shaft assemblies disposed at an angle of about 10 degrees relative to the floor.

7. The exercise machine of claim 1, wherein the second track assemblies take the form of front guide shaft assemblies, each including a cylindrical tube connected to a bifurcated bracket for holding one of the first rollers which rides upon the cam periphery.

8. The exercise machine of claim 7, wherein the cylindrical tube pivots through an angular range of about 5 to 10 degrees relative to the floor.

9. The exercise machine of claim 6, wherein each foot assembly includes a foot pedal mounted upon a support bar having a rearward end attached to a carriage assembly which rides back and forth on one of the rear guide shaft assemblies.

10. The exercise machine of claim 7, wherein each foot assembly includes a forward, lower end equipped with a roller which rolls back and forth along the cylindrical tube of the front guide shaft assembly.

11. The exercise machine of claim 9, wherein the carriage assembly includes a pair of side plates for holding a pair of upper rollers which ride on an upper surface of the rear guide shaft assembly, and a lower roller which rides on a lower surface of the rear guide shaft assembly.

12. The exercise machine of claim 11, wherein an adjustment device for changing the position of the rollers is provided on the carriage assembly.

13. The exercise machine of claim 2, wherein a pair of swing arms is pivotally connected to an upper portion of the support member and carries a pair of handles fixed thereto.

14. The exercise machine of claim 2, wherein the support member carries a pair of hand grips fixed thereto.

15. The exercise machine of claim 1, wherein the linkage arrangement includes a pair of bell cranks attached at one end to the drive shaft, a pair of forward connecting links, each having a first end pivotally connected to another end of one of the bell cranks, and a second end pivotally connected to a mid portion of one of the swing arms, and a pair of rear connecting links, each having a first end pivotally secured to a bottom end of one of the swing arms, and a second end pivotally connected to one of the carriage assemblies.

16. A method of walking/jogging in an exercise machine, the method comprising the steps of:

providing a frame supported on a generally horizontally extending floor;

mounting a drive shaft rotation on the frame;

mounting a pair of cams for rotation on the drive shaft;

fixing a pair of first track assemblies to the frame;

rotatably mounting a pair of second track assemblies to the frame such that the second track assemblies have brackets for holding first rollers which ride upon the peripheries of the cams;

mounting a pair of non-aligned, foot assemblies for sliding movement on the first and second track assembly; and providing a linkage arrangement between the cams and foot assemblies for transferring movement of the foot assemblies to the cams so as to produce a change in the angle of a user's ankle which will result in a natural walking/jogging motion.

* * * * *